US006716073B1

(12) United States Patent
Lee

(10) Patent No.: US 6,716,073 B1
(45) Date of Patent: Apr. 6, 2004

(54) ELECTRICALLY CONNECTING TERMINAL STRUCTURE

(75) Inventor: Ipson Lee, Taoyuan (TW)

(73) Assignee: Super Link Electronics Co., Ltd., Taoyuan (TW)

( * ) Notice: Subject to any disclaimer, the term of this patent is extended or adjusted under 35 U.S.C. 154(b) by 0 days.

(21) Appl. No.: 10/261,765

(22) Filed: Oct. 2, 2002

(51) Int. Cl.[7] ..... H01R 13/02
(52) U.S. Cl. ..... 439/885; 439/887; 439/884
(58) Field of Search ..... 439/884, 885, 439/887

(56) References Cited

U.S. PATENT DOCUMENTS 600,975 A * 3/1898 Andrew ..... 454/87
4,583,813 A * 4/1986 Yamada ..... 439/345
4,992,056 A * 2/1991 Douty et al. ..... 439/83
5,035,655 A * 7/1991 Hesse ..... 439/699.2
5,060,372 A * 10/1991 Capp et al. ..... 29/883
5,152,700 A * 10/1992 Bogursky et al. ..... 439/733.1
5,415,568 A * 5/1995 Kinoshita ..... 439/610

* cited by examiner

*Primary Examiner*—Truc Nguyen
(74) *Attorney, Agent, or Firm*—Rosenberg, Klein & Lee

(57) ABSTRACT

An electrically connecting terminal structure made of a metal sheet with unified thickness and including a first terminal section and a second terminal section. The second terminal section is bent from a lateral side of front end of the first terminal section and integrally axially extends therefrom. In a space defined by X axis, Y axis and Z axis, the thickness of the first terminal section parallel to X-Z plane is equal to the width of the second terminal section parallel to X-Y plane. Moreover, the thickness of the second terminal section parallel to X-Z plane is larger than the width of the second terminal section parallel to X-Y plane so that the second terminal section can meet the specification and a manufacturer can choose a thinner sheet material to manufacture the connecting terminal meeting the specification so as to reduce cost for the material.

1 Claim, 6 Drawing Sheets

ELECTRICALLY CONNECTING TERMINAL STRUCTURE

BACKGROUND OF THE INVENTION

1. Field of the Invention

The present invention is related to an electrically connecting terminal structure in which the thickness of a terminal section is larger than the thickness of a sheet material chosen for manufacturing the connecting terminal.

2. Description of the Prior Art

FIGS. 1, 2 and 3 show the connecting terminals of an existent connector. The terminals are made of one sheet material with unified thickness by way of punching. The terminal includes a first section 31 and a second section 32 al extending from the first section 31. The second section 32 is inlaid in the connector 4 for electrically connecting with an electric element such as a PCMCIA (Personal Computer Memory Card International Association). The first section 31 is connected with a circuit board. Due to demand of specification, in manufacturing, the thickness of the sheet material must conform with the required thickness t of the second section 32.

However, in application, the first section 31 of the connecting terminal is simply fixedly connected with the circuit board. Therefore, the first section 31 does not necessitate too thick thickness. Accordingly, it leads to a waste of material to make the connecting terminal with a sheet material of a thickness equal to that of the second section.

Moreover, the second section 32 horizontally extends from the first section 31 on the same plane. The second section 32 is quite slender. (There are various length specifications of the second section 32. The shortest specification can be 20 mm, while the longest specification is up to 50 mm.) When clamping the first section 31 to insert the second section 32 into the connector 4, the second section 32 is quite easy to bend and deform as shown by phantom line of FIG. 3. This results in defective product. Furthermore, the width w of the first and second sections is not larger than the thickness t. Therefore, during punching, the terminal is quite easy to deflect as shown by phantom line of FIG. 1. Accordingly, it is quite troublesome and time-consuming to punch the material band to form the terminals one by one.

SUMMARY OF THE INVENTION

It is therefore a primary object of the present invention to provide an electrically connecting terminal structure made of a metal sheet with unified thickness and including a first terminal section and a second terminal section. The second terminal section is bent from a lateral side of front end of the first terminal section and integrally axaily extends therefrom. In a space defined by X axis, Y axis and Z axis, the thickness of the first terminal section parallel to X-Z plane is equal to the width of the second terminal section parallel to X-Y plane. Moreover, the thickness of the second terminal section parallel to X-Z plane is larger than the width of the second terminal section parallel to X-Y plane so that the second terminal section can meet the specification and a manufacturer can choose a thinner sheet material to manufacture the connecting terminal meeting the specification so as to reduce cost for the material.

The present invention can be best understood through the following description and accompanying drawings wherein:

DETAILED DESCRIPTION OF THE PREFERRED EMBODIMENT

Figure 2:
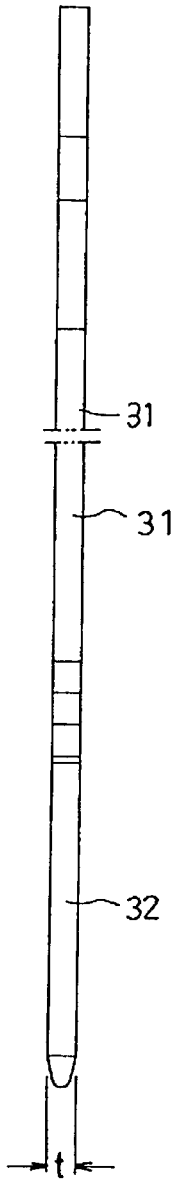
Fig. 2 PRIOR ART
FIG. 2 is a side view the conventional connecting terminal.
Figure 1:
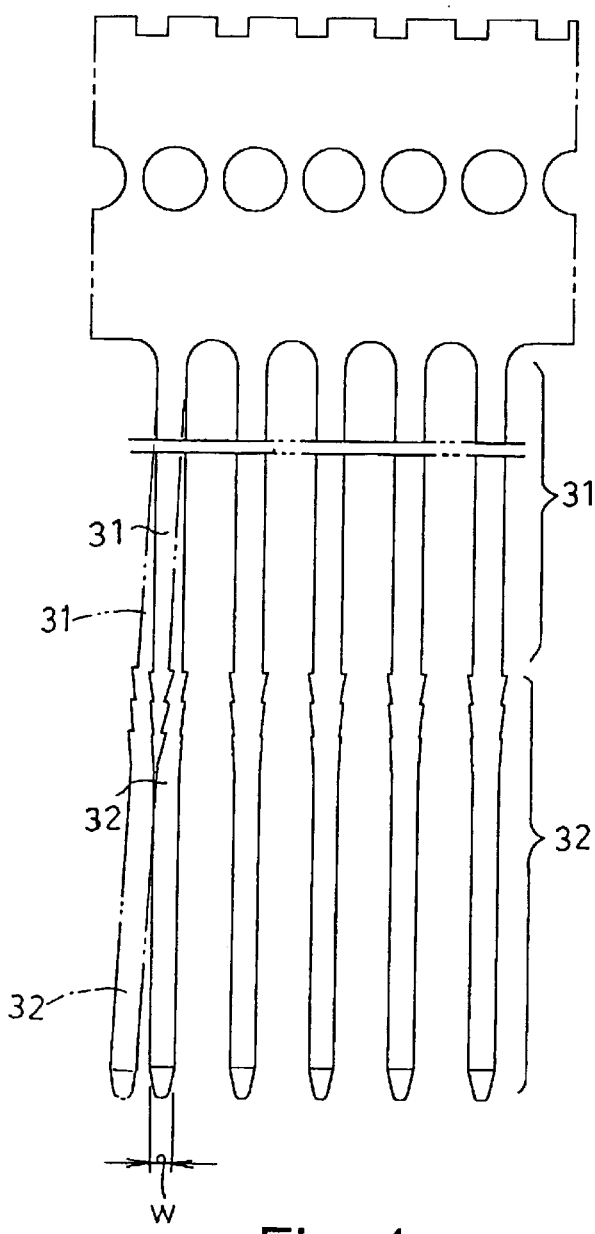
Fig. 1 PRIOR ART
FIG. 1 is a plane view of the material band of conventional connecting terminals.
Figure 3:
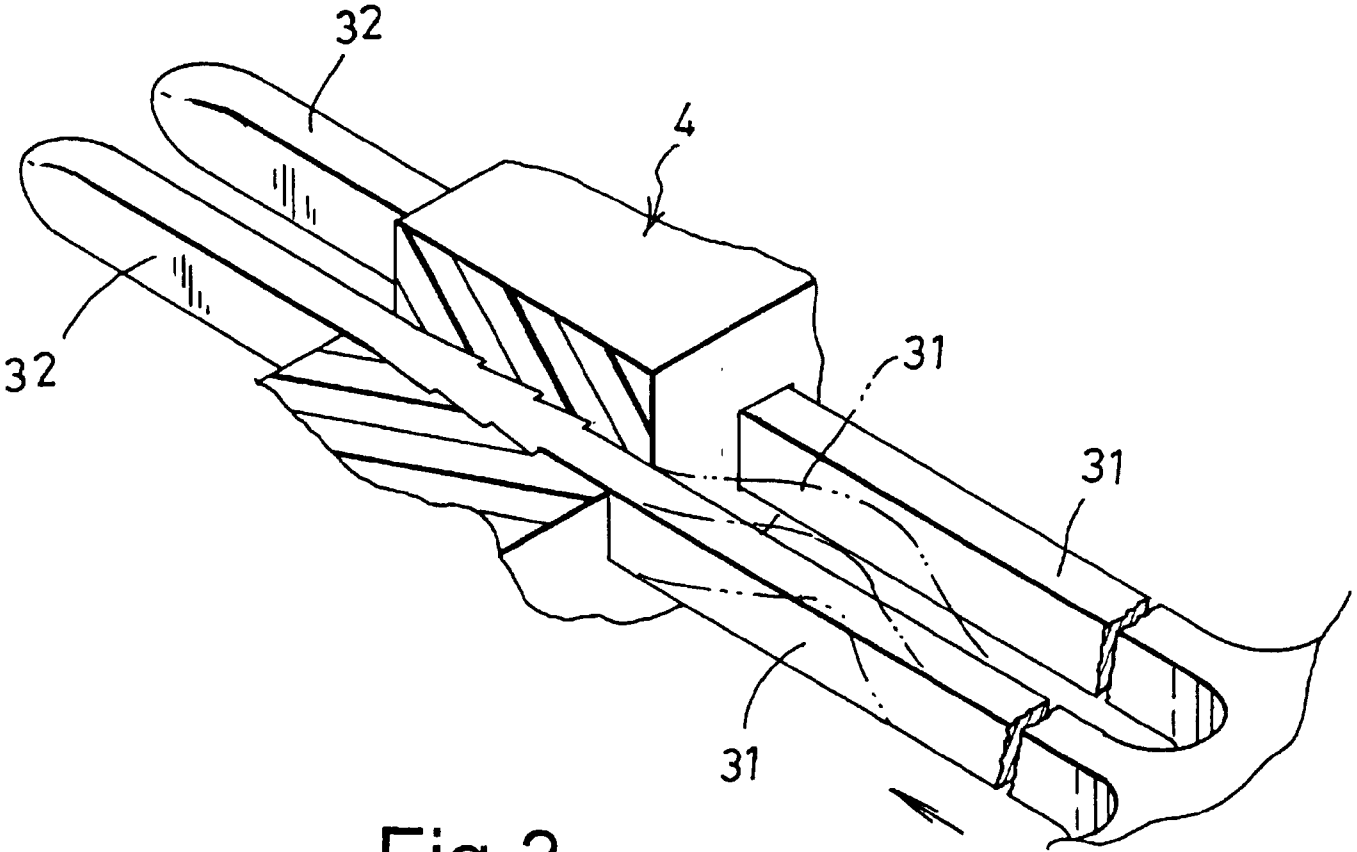
Fig.3 PRIOR ART
FIG. 3 shows that the conventional connecting terminal is inserted into a connector.
Figure 4:
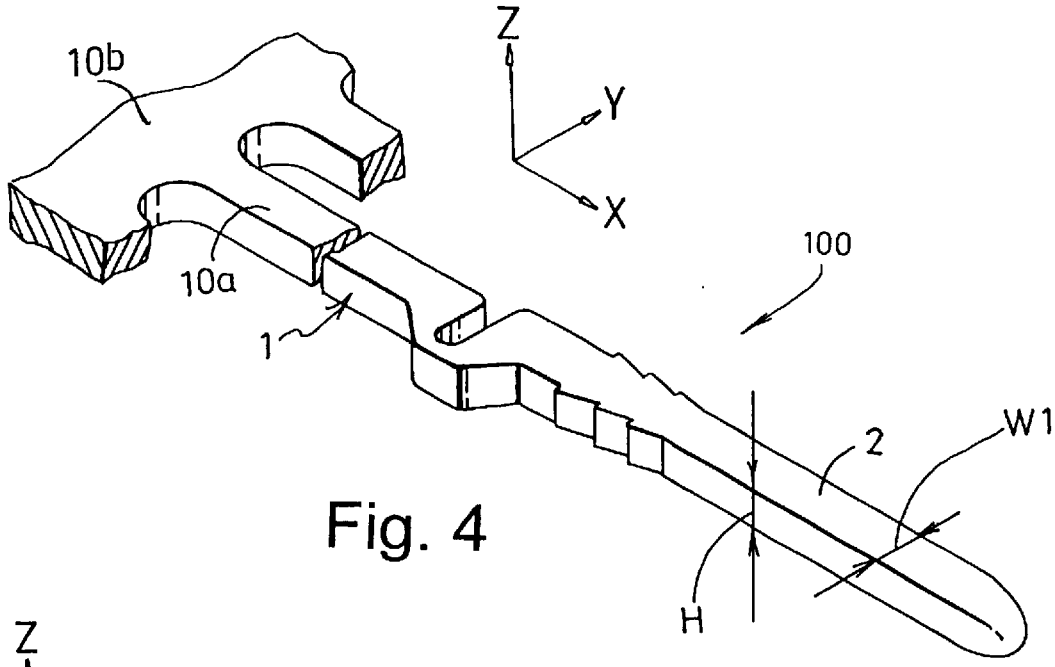
FIG. 4 shows the connecting terminal of the present invention, in which the second terminal section is not bent yet.
Figure 5:
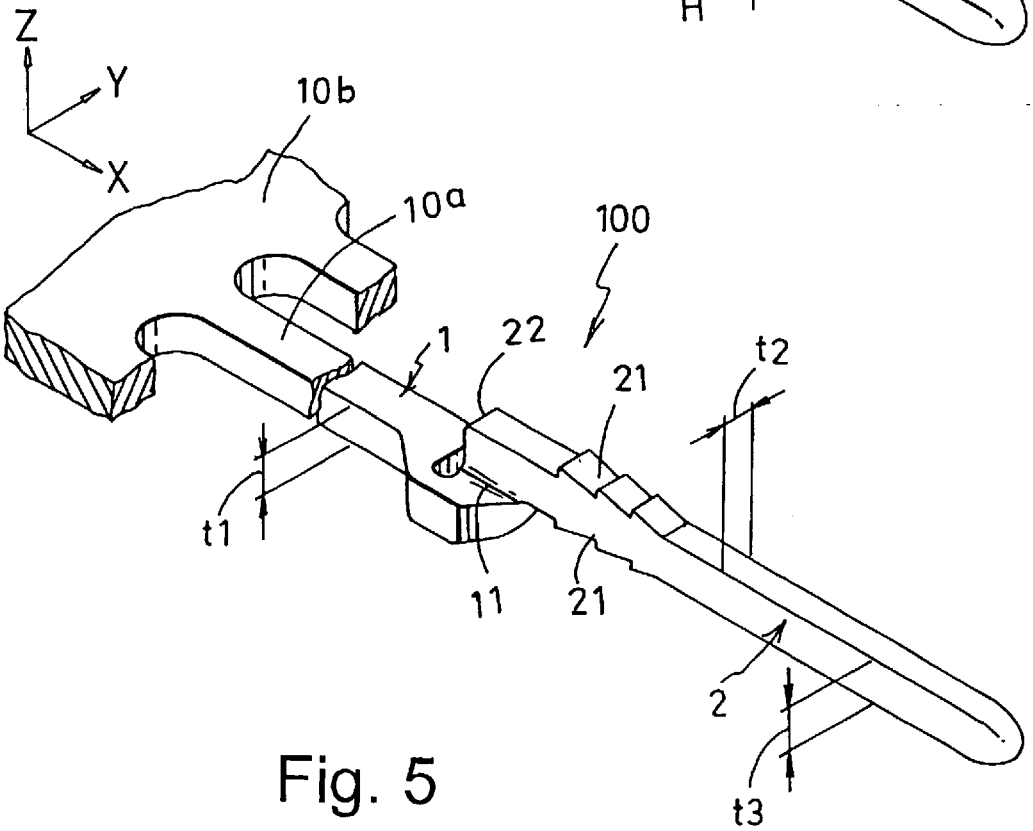
FIG. 5 shows the connecting terminal of the present invention according to FIG. 4, in which the second terminal section is bent.
Figure 7:
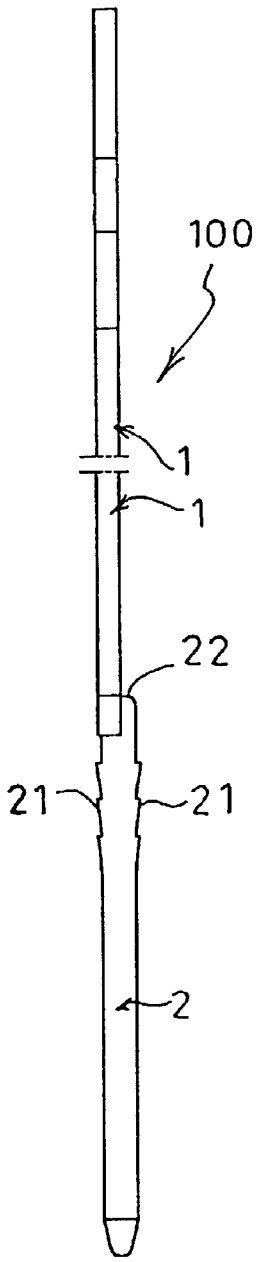
FIG. 7 is a side view according to FIG. 4.
Figure 6:
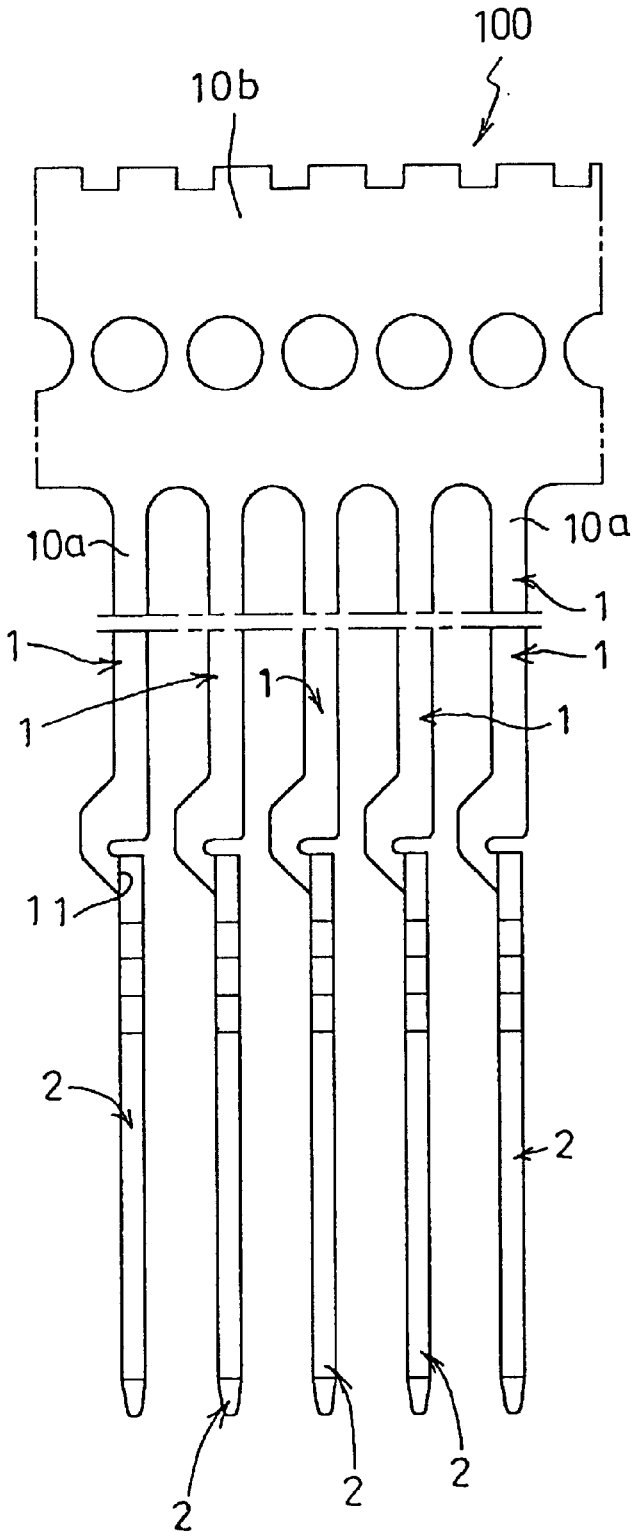
FIG. 6 is a plane view of the material band of the connecting terminals of the present invention.
Figure 8:
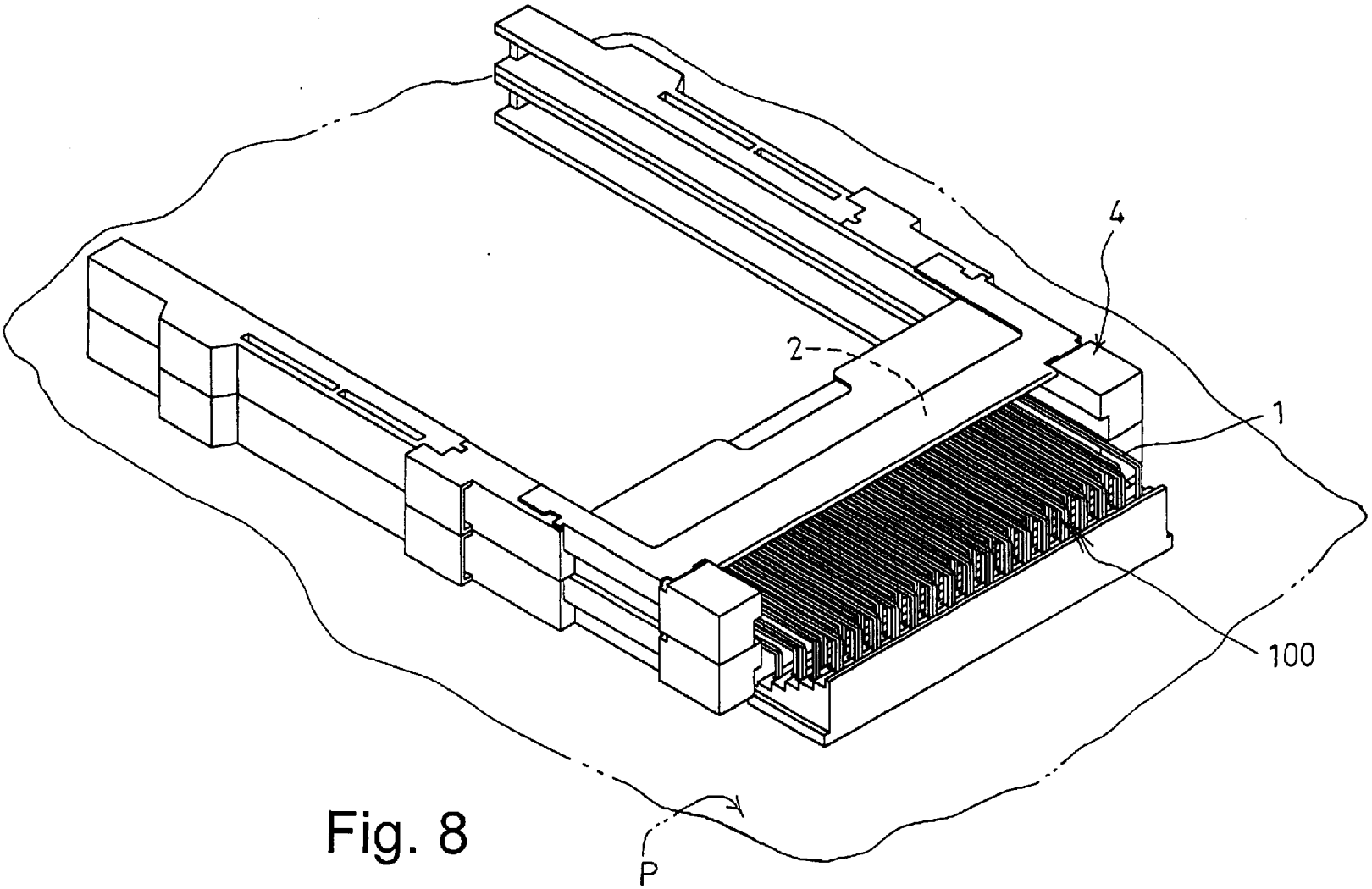
FIG. 8 shows that the connecting terminal of the present invention is inserted into a connector.
Figure 9:
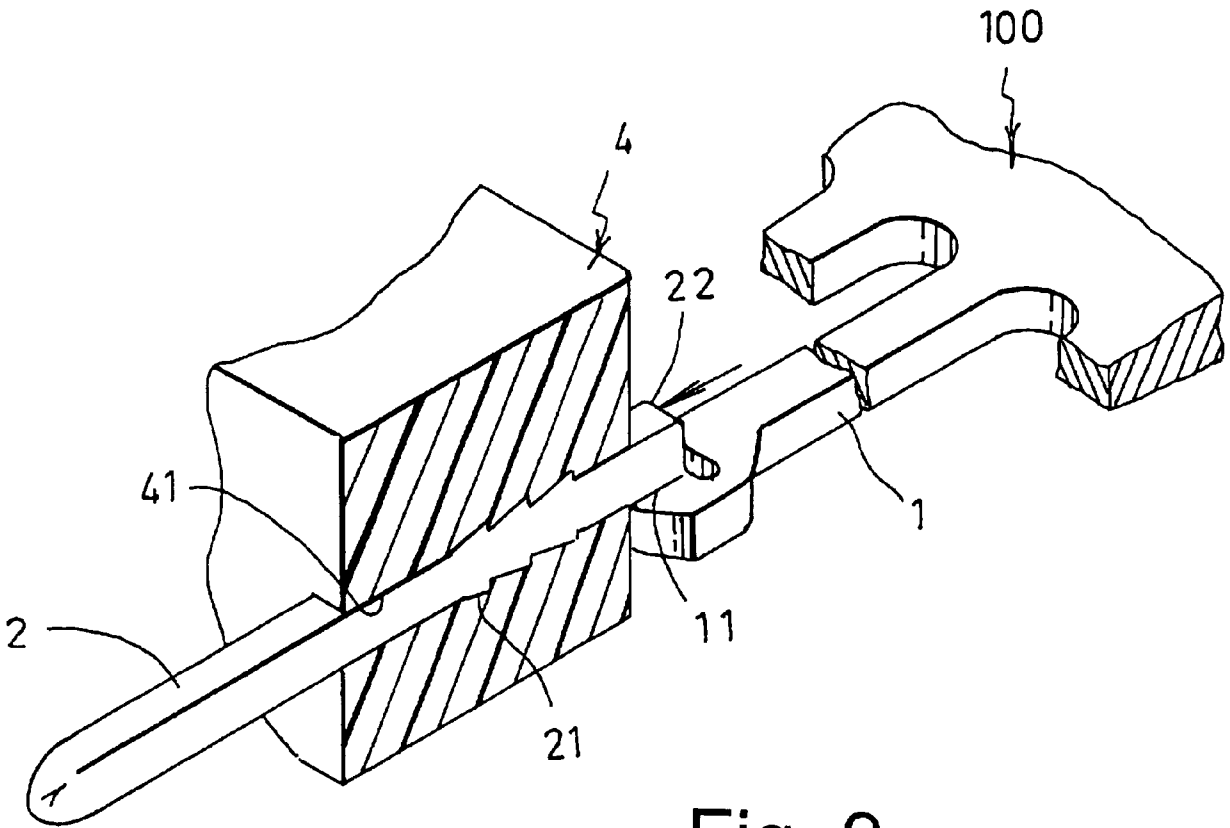
FIG. 9 is a sectional view showing that the connecting terminal of the present invention is tightly inserted in the connector.

Please refer to FIGS. 4 to 9. The electrically connecting terminal structure of the present invention is made of a metal sheet with unified thickness. The terminal includes a first terminal section 1 and a second terminal section 2. In manufacturing, the root sections 10*a* of the connecting terminals 100 are integrally connected with a metal band body 10*b* side by side to form a material band so as to facilitate manufacturing of the connector 4. For easy illustration, as shown in FIG. 5, the lengthwise direction of the connecting terminal 100 is defined as X axis. A direction coplanar with X axis and normal to X axis defined as Y axis. A direction normal to X-Y plane is defined as Z axis.

Referring to FIG. 5, the second terminal section 2 is bent from a lateral side 11 of front end of the first terminal section 1 and integrally axially extends therefrom. Accordingly, in the space defined by X axis, Y axis and Z axis, the thickness t1 of the first terminal section 1 parallel to X-Z plane is equal to the width t2 of the second terminal section 2 parallel to X-Y plane. Moreover, the second terminal section 2 is bent from the front end of the first terminal section 1 and integrally extends therefrom. Therefore, the thickness t3 of the second terminal section 2 parallel to X-Z plane is larger than the width t2 of the second terminal section 2 parallel to X-Y plane so that the second terminal section 2 can meet the specification. Accordingly, the manufacturer can choose a thinner sheet material without being limited to the thickness t3 of the second terminal section 2. Therefore, a connecting terminal can be made of thinner sheet material in conformity with the specification so as to save material.

The upper and lower edges of the second terminal section 2 are formed with at least one engaging tooth 21 so as to tightly insert the connecting terminal 100 into the terminal cavity 41 of the connector 4. In addition, a bent stop shoulder 22 is formed at an adjoining section between the first and second terminal sections 1, 2. A force can be exerted onto the stop shoulder 22 to push the connecting terminal 100. Moreover, the stop shoulder 22 serves as a reinforcing rib for increasing the bending strength of the connecting terminal 100. Accordingly, when inserted into the connector 4, the connecting terminal is prevented from being bent and deformed.

Referring to FIG. 4, in first punch, the first and second terminal sections 1, 2 are formed on the same plane and the width W1 parallel to the X-Y plane is larger than the thickness H parallel to the X-Z plane (that is, the thickness of the chosen sheet material). Therefore, in the punch, the connecting terminals will not be laterally deflected. Accordingly, multiple connecting terminals can be side by side punched at one time so as to shorten manufacturing time and enhance production efficiency.

According to the above arrangement, the present invention has the following advantages:

1. A thinner sheet material can be used to manufacture the connecting terminal meeting the standard specification. Therefore, the cost for the material can be greatly reduced.

2. Multiple connecting terminals can be punched at one time so as to facilitate and speed the manufacturing procedure.

3. The connecting terminal has enhanced strength and is not subject to bending and deformation during installation. Therefore, the ratio of good products is increased.

The above embodiment is only used to illustrate the present invention, not intended to limit the scope thereof. Many modifications of the above embodiment can be made without departing from the spirit of the present invention.

What is claimed is:

1. An electrically connecting terminal structure made of a metal sheet of uniform thickness, the connecting terminal comprising a first terminal section at one longitudinal end thereof, a second terminal section at an opposing longitudinal end of the connecting terminal, and a stop shoulder at an adjoining section disposed between the first and second terminal sections, the second terminal section being bent from a lateral side of a distal end of the first terminal section and extending longitudinally therefrom to define a terminal pin, a longitudinal direction of the connecting terminal being defined as an X axis, a direction coplanar with the X axis and normal to the X axis being defined as a Y axis, a direction normal to an X-Y plane being defined as a Z axis, a thickness of the first terminal section parallel to a X-Z plane being equal to a width of the second terminal section parallel to the X-Y plane, a thickness of the second terminal section parallel to the X-Z plane being larger than the width of the second terminal section parallel to the X-Y plane, whereby the thickness of the second terminal section meets a connector standard specification using a thinner sheet material than the standard specification, the second terminal section having a plurality of engaging teeth respectively formed on upper and lower edges thereof for engagement with an internal surface of a connector terminal cavity into which the second terminal section is installed.

* * * * *